United States Patent [19]

Häger

[11] 4,337,720

[45] Jul. 6, 1982

[54] APPARATUS FOR TREATMENT OF WOOD

[76] Inventor: Bror O. Häger, Forsetevägen 5, S182 63 Djursholm, Sweden

[21] Appl. No.: 205,187

[22] Filed: Nov. 10, 1980

[30] Foreign Application Priority Data

Nov. 13, 1979 [SE] Sweden ..... 7909340

[51] Int. Cl.[3] ..... B05C 3/109

[52] U.S. Cl. ..... 118/50; 118/429; 427/297; 427/440; 427/441

[58] Field of Search ..... 427/297, 440, 441; 118/50, 429

[56] References Cited

U.S. PATENT DOCUMENTS 2,036,261 4/1936 Dinley ..... 118/429
2,295,912 9/1942 Pagenkopf ..... 118/429
2,930,349 3/1960 Jones ..... 118/429
3,870,068 3/1975 Dutkewych et al. ..... 118/429

FOREIGN PATENT DOCUMENTS 366743 1/1923 Fed. Rep. of Germany ..... 427/440

*Primary Examiner*—Ralph S. Kendall
*Attorney, Agent, or Firm*—Burns, Doane, Swecker & Mathis

[57] ABSTRACT

An apparatus is disclosed for use in the preservative treatment and/or drying or coloring of wood. The apparatus consists of an enclosed vessel which is divided into two chambers by an intermediate wall portion. Wood to be treated is placed in one chamber in a treatment liquid, with the liquid passing into the second chamber by passing over said intermediate wall portion.

6 Claims, 1 Drawing Figure

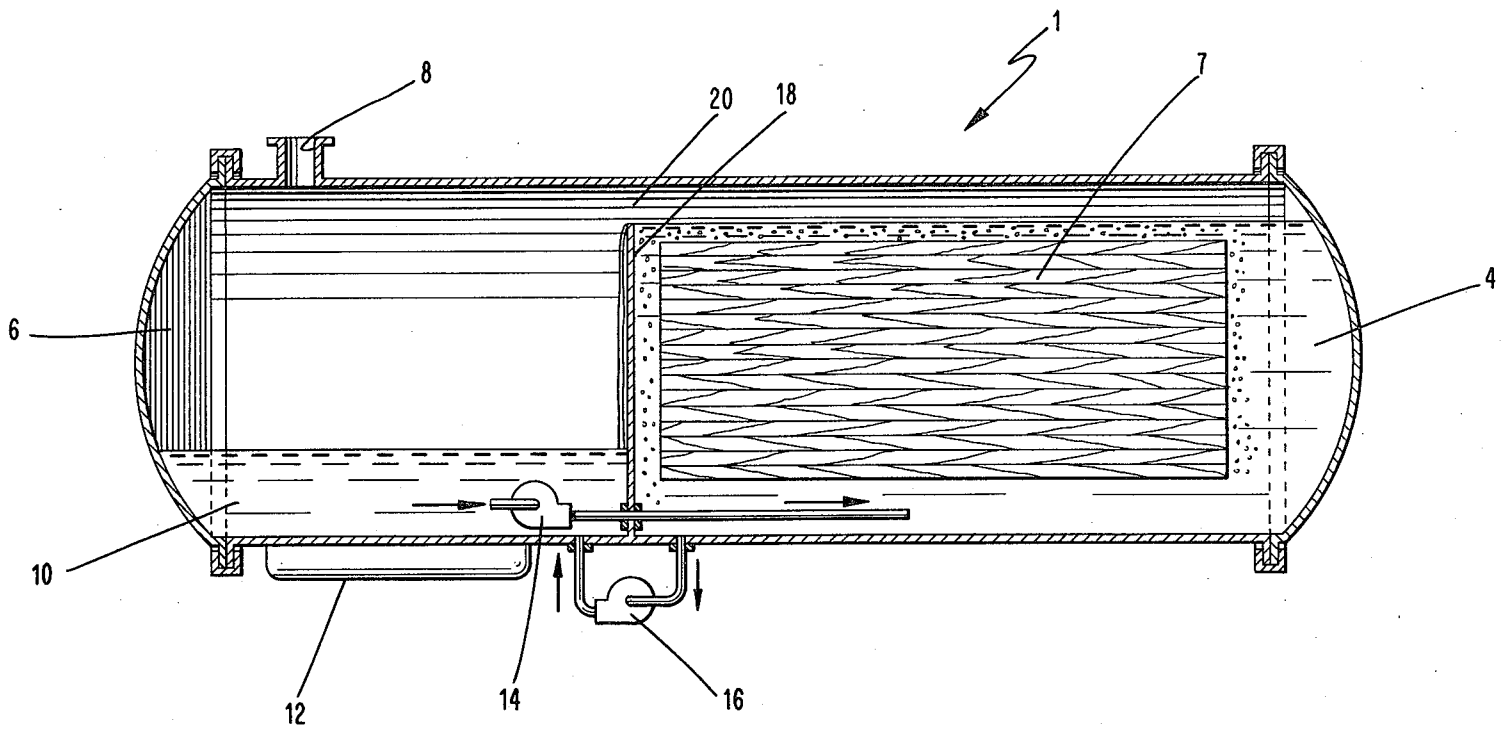
1
4
7
18
20
8
6
10
14
16
12

APPARATUS FOR TREATMENT OF WOOD

The present invention is directed to an apparatus for use in the preservative treatment, drying, and/or coloring of wood.

The apparatus comprises an enclosed vessel which is divided into two chambers by an intermediate wall portion. Wood which is to be treated and/or dried is placed in one chamber (the treatment chamber) while the other chamber (the storage chamber) serves as a receptacle to store the preservative liquid or drying-/coloring oil, etc. which is employed. The intermediate wall portion is of suitable height and/or configuration such that communication between the two chambers is possible through an opening above or in the wall portion. The opening permits an equalization of pressure to be obtained throughout the vessel. A liquid which is used in the preservative and/or drying treatment may pass from the treatment chamber to the storage chamber by flowing over the top of the wall portion (or through an opening therein) when the liquid level in the treament chamber is sufficiently high.

Since the pressure which is maintained on the wood and the stored preservative liquid is the same, preservative treatment of the wood by processes such as the Rueping process where the preservative is carried to the wood under constant pressure is facilitated. In addition, the treatment liquid can be easily and rapidly transported between the storage chamber and the treatment chamber in view of the absence of pressure variations and accompanying control means which would be required. This is of importance, for instance, when the wood is dried in a hot oil under a vacuum. Such drying is often carried out using short, repetitive drying cycles. The pressure must be controlled and stabilized to avoid unnecessary oil absorption by the wood. The uppermost edge of the dividing wall may act as a spillway for the preservative liquid whereby protection is obtained against inundations of the treatment liquid to coolers and vacuum units with associated fouling being prevented.

The apparatus is also suitable for wood treatment processes wherein the wood is dried or colored. A special advantage with respect to the use of the apparatus of the present invention in such processes is the above-noted easily effected movement of the treatment liquid from the storage chamber to the treatment chamber. This movement can advantageously occur in a continuous and uninterrupted manner resulting in an agitation of the treatment liquid in addition to that provided by steam bubbles which are present. The steam bubbles emanate from the water in the form of a preservative solution from the wood. Under prevailing conditions, such as a temperature of about 80° C. and a high vacuum, the water will boil away. The bubbles can exhibit a large volume depending upon the vacuum. Such agitation ensures the suspension of the coloring pigments in the treatment liquid which is of importance when heavier pigments are used, such as, instance, ordinary iron pigments.

The treatment liquid is preferably pumped into the treatment chamber from the storage chamber beneath the wood located therein where it is distributed by suitable piping arrangement. In this way, the treatment chamber may be filled up to the uppermost edge of the dividing wall. The oil may then flow over the wall and return to the storage chamber. Even in this case, full security is obtained against overflows with its disadvantages which otherwise can be caused by the intense foaming which may occur during the drying of the wood under a high vacuum. In addition, since the same pressure always prevails in the treatment chamber and the storage chamber due to the communication between the chambers, no accidental pressure differences occur which otherwise can result in unnecessary oil absorption by the wood.

The FIGURE presents an embodiment of the invention.

More specifically, the apparatus of the present invention will be discussed in connection with the FIGURE which depicts the apparatus of the present invention in operation. The apparatus is preferably in the form of an enclosed cylindrical vessel 1 comprised of a suitable material such as iron. Each end of the vessel includes suitable access means such as openings (not shown) in the vessel adjacent the treatment chamber 4 and storage chamber 6 which permit entry thereto. The vessel may be sealed against the ambient environment by closing such openings by suitable means such as lids. The opening adjacent the treatment chamber permits entry therein to place wood 7 into (as well as to remove wood from) the treatment chamber. Pressure (or vacuum) in each chamber in the vessel is suitably maintained by appropriate means (not shown) connected to the interior of the vessel via outlet 8. The distance from the outlet 8 to the surface of the treatment liquid 10 in the storage chamber is suitably maintained to avoid disturbances from the agitated liquid, splash and foam present.

Suitable heating means 12 for heating the treatment liquid can be employed adjacent the storage chamber 6. The treatment liquid can be heated in various conventional ways, such as by circulation of the treated liquid through a heat exchanger, by external heating of the vessel via a heating jacket, etc. Such heat treatment means need not to be used solely to heat the treatment liquid in the storage chamber, as it can also be employed with respect to the treatment chamber. It should be noted that when the Rueping treatment method is used, the treatment liquid is generally heated to about 80° to 100° C. In addition, the oil used in the drying/coloring of wood is generally heated to about 60° to 80° C.

The treatment liquid may be transported from the storage chamber to the treatment chamber by suitable means such as by use of a pump 14. Preferably, a separate pump 16 is used to empty the treatment chamber by pumping treatment liquid from the treatment chamber to the storage chamber.

The treatment chamber 4 will generally be larger in dimension than the storage chamber 6. The treatment chamber must, of course, be of sufficient size to enable the wood which is to be treated to be placed therein and for the treatment liquid to be placed in the treatment chamber and sufficiently surround the wood. The storage chamber, however, need not necessarily have sufficient capacity to store all of the treatment liquid used for the treatment of the wood. A separate secondary storage tank (not shown) can be used to complement the storage chamber 6.

The intermediate wall portion 18 extends across the interior of the vessel to form the treatment and storage chambers and is of sufficient height to provide an open space 20 above the upper most portion thereof through which the pressure is equalized via communication between the two chambers and through which the treatment liquid admixed with steam bubbles can flow back to the storage chamber. The wall portion 18 should be of sufficient height, however, such that the treatment liquid covers the wood in the treatment chamber. The height of the wall portion will generally be at least about 90 percent of the diameter of the vessel. As depicted in the FIGURE, the wall portion may extend upwardly from the bottom of the vessel, terminating prior to reaching the top of the vessel, with the uppermost portion being substantially horizontal so as to provide means whereby the treatment liquid can flow over the wall.

Openings of varying size and number may be provided at a suitable height or heights in the intermediate wall portion in lieu of providing an opening above the uppermost portion of the wall portion.

In operation, wood to be treated is placed in the treatment chamber and surrounded by treatment liquid such as a preservative liquid which may be any conventionaal aqueous or oil-based preservative liquid. The preservative liquid, may be heated in the storage chamber and then pumped into the treatment chamber beneath the wood. As the level of the treatment liquid rises sufficiently in the treatment chamber, it flows over the intermediate wall portion into the storage chamber.

If moist or preservative treated wood is alternatively to be dried and/or colored, it is placed in a drying oil in the treatment zone which is sufficiently heated to drive off moisture from the wood. Generally, the interior of the vessel is maintained under a high vacuum to aid in removal of the drying oil and/or moisture from the wood. The drying oil is circulated between the storage chamber and the treatment chamber.

The construction of the vessel can be varied in different ways without departing from the spirit of the invention. For example, the vessel need not be cylindrical but can be of any other suitable configuration. Furthermore, the vessel can be divided into more than two parts to provide several storage chambers for different treatment liquids as well as several treatment chambers. Preferably, however, the vessel is cylindrical and divided into two separate chambers.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. An apparatus for the treatment of wood comprising:

a vessel, said vessel including a storage chamber for the storage of treatment liquid and a treatment chamber wherein wood can be contacted with said treatment liquid, said vessel further including means to exclude ambient air from the interior of the vessel, said storage chamber and said treatment chamber being separated by a substantially vertical intermediate wall portion which includes means to permit communication between the storage chamber and the treatment chamber to equalize the pressure in each chamber, said communication means further enabling said treatment liquid in said treatment chamber to flow into said storage chamber upon achieving a desired level in said treatment chamber.

2. The apparatus of claim 1 further including means to maintain the interior of said vessel under pressure.

3. The apparatus of claim 1 further including means to maintain the interior of said vessel under a vacuum.

4. The apparatus of claim 1 further including means to heat treatment liquid present within said vessel.

5. The apparatus of claim 4 wherein said heating means comprises a heating jacket.

6. The apparatus of claim 1 wherein said intermediate wall portion is of such dimension that said treatment liquid may flow over the top of said wall portion from said treatment chamber into said storage chamber.

* * * * *